United States Patent [19]

Wykes et al.

[11] Patent Number: 4,813,113

[45] Date of Patent: Mar. 21, 1989

[54] OVERHUNG ROLL ASSEMBLY

[75] Inventors: Philip Wykes, Shrewsbury; David L. Pariseau, Southbridge, both of Mass.

[73] Assignee: Morgan Construction Company

[21] Appl. No.: 133,798

[22] Filed: Dec. 16, 1987

[51] Int. Cl.[4] ..... B23P 19/00; B23P 19/04

[52] U.S. Cl. ..... 29/122; 29/129

[58] Field of Search ..... 29/117, 122, 129, 148.4 D

[56] References Cited

U.S. PATENT DOCUMENTS

| | | | |
|---|---|---|---|
| 2,631,860 | 3/1953 | Bronson | 29/117 |
| 3,803,691 | 4/1974 | Geese et al. | 29/148.4 D X |
| 4,208,147 | 6/1980 | Giege et al. | 29/117 |

*Primary Examiner*—Timothy V. Eley

*Attorney, Agent, or Firm*—Samuels, Gauthier, Stevens & Kehoe

[57] ABSTRACT

A rolling mill roll assembly includes a roll shaft having a tapered portion located adjacent to an end portion. An annular tungsten carbide work roll is received on the tapered shaft portion. The work roll has circumferentially spaced keys integrally formed on its outer face. A tapered sleeve is axially wedged between the work roll and the tapered shaft portion. A drive ring is connected to the sleeve. The drive ring is splined to the shaft end portion and is provided with lug members which are axially received between and which are rotatably engaged with the keys on the outer roll face. Driving torque is thus transmitted from the shaft to the roll via the driving ring, with the roll being concentrically located with respect to the shaft axis by the tapered sleeve.

13 Claims, 5 Drawing Sheets

OVERHUNG ROLL ASSEMBLY

BACKGROUND OF THE INVENTION

1. Field of the Invention

This invention relates generally to rolling mills, and is concerned in particular with an improved roll assembly of the "cantilevered" or "overhung" type commonly employed in the single strand rolling of steel rod and bar products.

2. Description of the Prior Art

In the above-mentioned type of roll assembly, care must be taken to avoid overstressing the roll material when operating under high load conditions. Overstressing can result from the high separating forces typically encountered when rolling at lower temperatures, or from roll profiles having increased groove depths, or from combinations of the foregoing. When such high stress conditions are encountered, conventional roll mounting assemblies of the type disclosed, for example, in U.S. Pat. No. 3,803,691, are no longer considered adequate.

A general objective of the present invention is to provide an improved roll assembly which minimizes roll stresses when rolling under high load conditions.

A more particular objective of the present invention is to provide an improved means of transmitting torque from the roll shaft to the work roll, while at the same time maintaining the work roll securely aligned concentrically with the roll shaft axis.

A further object of the present invention is to provide a roll assembly which can be rapidly and efficiently mounted on and removed from the roll shaft by means of a single hydraulically actuated tool.

SUMMARY OF THE INVENTION

In a preferred embodiment of the invention to be described hereinafter in greater detail, a rolling mill roll assembly includes a roll shaft having a tapered portion located adjacent to an end portion. An annular tungsten carbide work roll is received on the tapered shaft portion. The work roll has circumferentially spaced keys integrally formed on its outer face. A tapered sleeve is axially wedged between the work roll and the tapered shaft portion. A drive ring is connected to the sleeve. The drive ring is splined to the shaft end portion and is provided with lug members which are axially received between and which are rotatably engaged with the keys on the outer roll face. Driving torque is thus transmitted from the shaft to the roll via the driving ring, with the roll being concentrically located with respect to the shaft axis by the tapered sleeve.

DETAILED DESCRIPTION OF ILLUSTRATED EMBODIMENT

Figure 1:
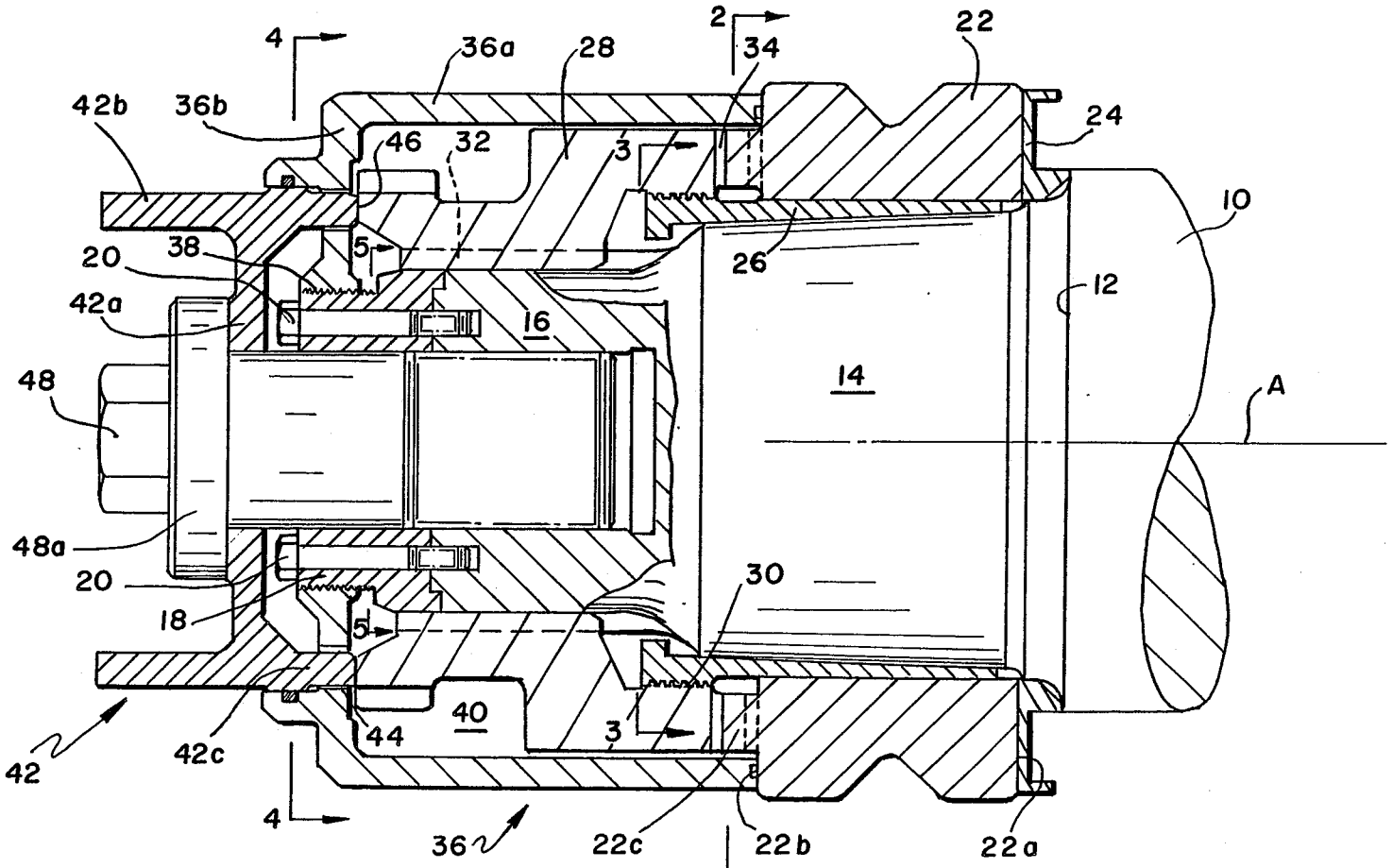
FIG. 1 is a sectional view through a rolling mill roll assembly in accordance with the present invention.
Figure 2:
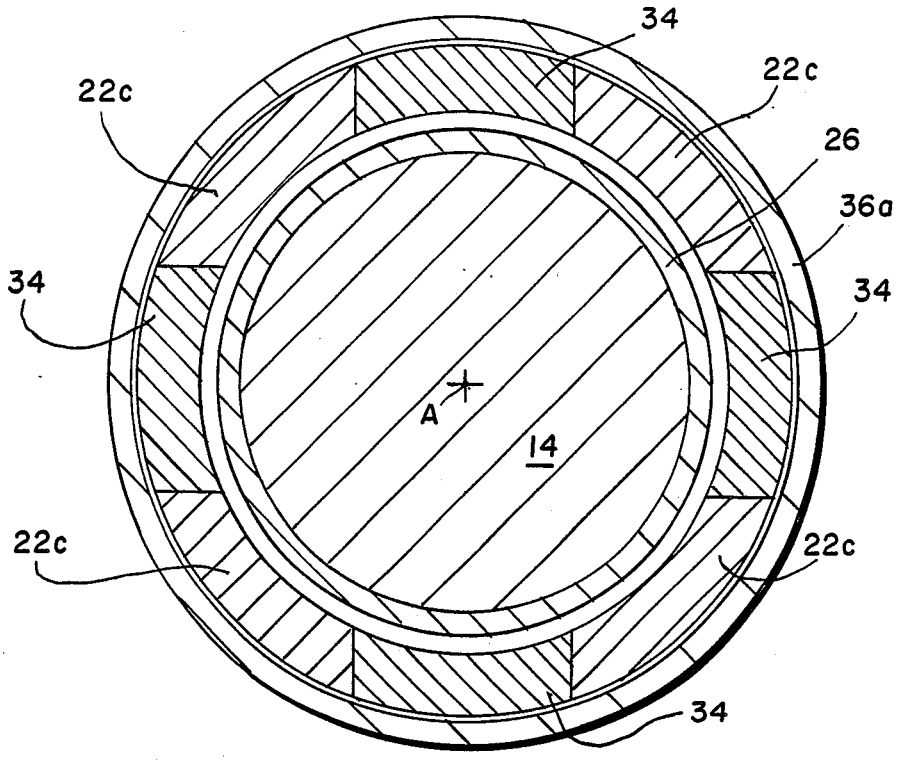
FIGS. 2, 3, 4 and 5 are sectional views taken respectively along lines 2—2, 3—3, 4—4 and 5—5 of FIG. 1.
Figure 3:
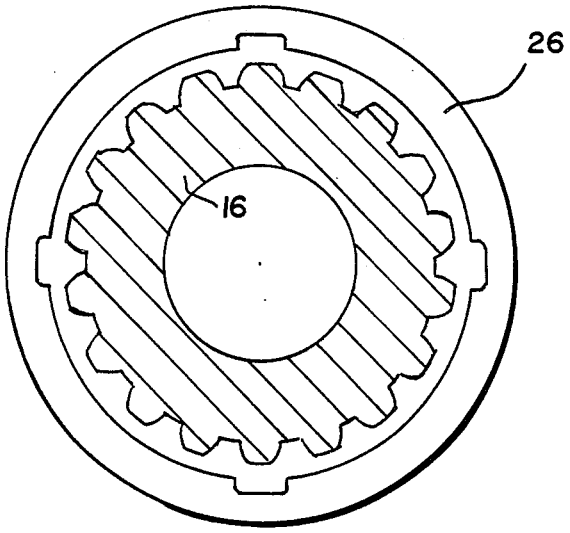
Figure 4:
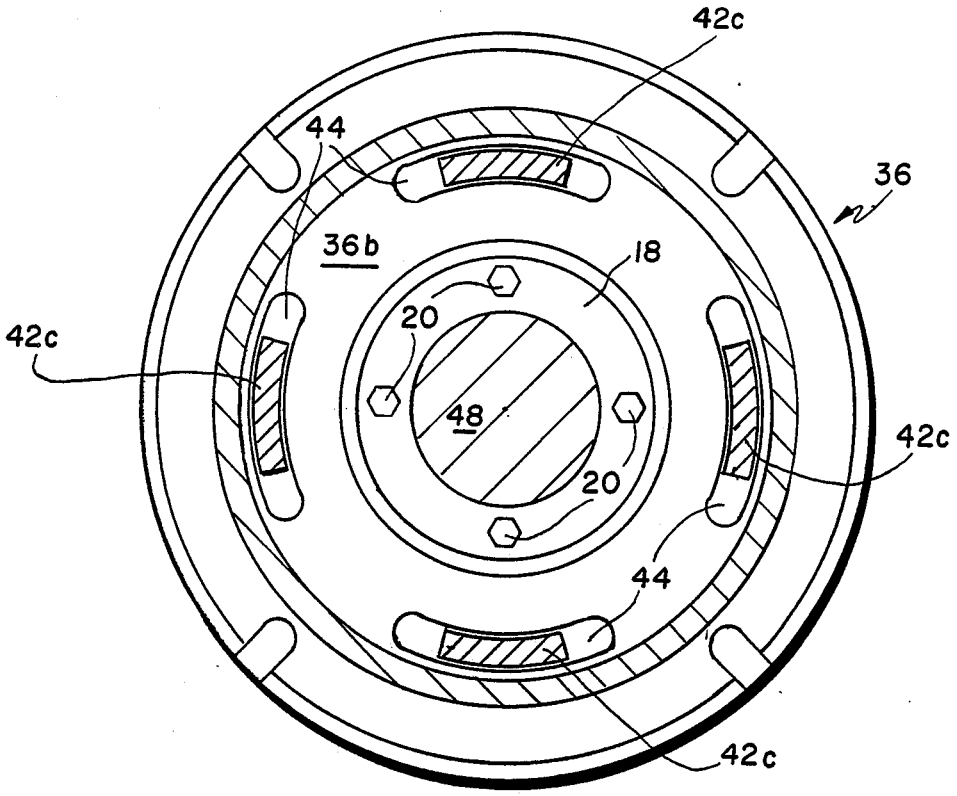
Figure 5:
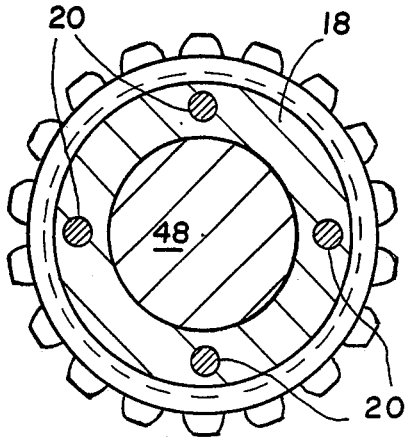

With reference initially to FIGS. 1-5, the roll assembly of the present invention includes a roll shaft 10 having a shoulder 12 leading to a tapered portion 14 which in turn leads to an end portion 16. An end cap 18 is secured to the shaft end by means of bolts 20.

An externally grooved annular tungsten carbide work roll 22 surrounds the tapered shaft portion 14. A seal flinger 24 is interposed between the inner face **22*a* of the work roll and the shaft shoulder 12. The flinger forms part of a conventional seal assembly, the remaining components of which have not been illustrated. The outer face 22*b* of the roll is provided with a plurality of integrally formed keys 22*c* the circumferentially spaced arrangement of which can best be seen in FIG. 2**.

A tapered sleeve 26 is axially received in a tightly wedged position between the cylindrical inner wall surface of the roll 22 and the tapered shaft portion 14. The sleeve serves to securely position the roll concentrically with respect to the shaft axis "A".

A drive ring 28 is threadedly connected as at 30 to an exposed end of the tapered sleeve 26. The drive ring is splined as at 32 to the shaft end portion 16. Lug members 34 on the drive ring are axially received between and are thus rotatably engaged with on the keys **22*c* on the outer face of the roll. It will be seen, therefore, that with this arrangement, torque is transmitted from the shaft 10 to the work roll 22 via the drive ring 28**.

The flinger 24 constitutes an abutment means serving to axially locate the roll 22 along the axis A of the shaft 10. The roll is held against the flinger 24 by a first retainer means which includes the end cap 18 and a cover 36. The cover has a cylindrical side wall **36*a* which is open at the end facing towards the work roll 22, and which is closed at the opposite end by an end wall 36*b*. The end wall 36*b* is threaded to the end cap 18 as at 38. By tightening the cover 36 on the end cap 18, the open end of the cylindrical side wall 36*a* is urged against the outer face 22*b* of the roll, thus pushing the roll against the flinger 24**.

The cover 36 coacts with the end cap 18 and the outer face **22*b* of the work roll 22 to define a cylindrical chamber 40 containing the drive ring 28. The mechanical interengagement between the lugs 34 and the work roll face keys 22*c*** is thus safeguarded from exposure to cooling water and mill scale during the rolling operation.

A second retainer means serves to prevent the sleeve 26 from becoming axially dislodged from between the tapered shaft portion 14 and the inner surface of the work roll 22. The second retainer means includes a collar member 42 having a radially inwardly projecting wall **42*a*, a cylindrical skirt 42*b*, and axially extending circumferentially spaced tabs 42*c* which protrude through slots 44 in the cover end wall 36*b* to abut the drive ring 28 as at 46. A retainer bolt 48 is threaded into the end of the roll shaft. The bolt 48 has a collar 48*a* which bears against the end wall 42*a* of the collar member 42, thereby urging the tabs 42*c* of the collar member against the drive ring 28, the latter being threaded to the sleeve 26 at 30. The sleeve 26** is thus held in its axially wedged position.

Figure 6:
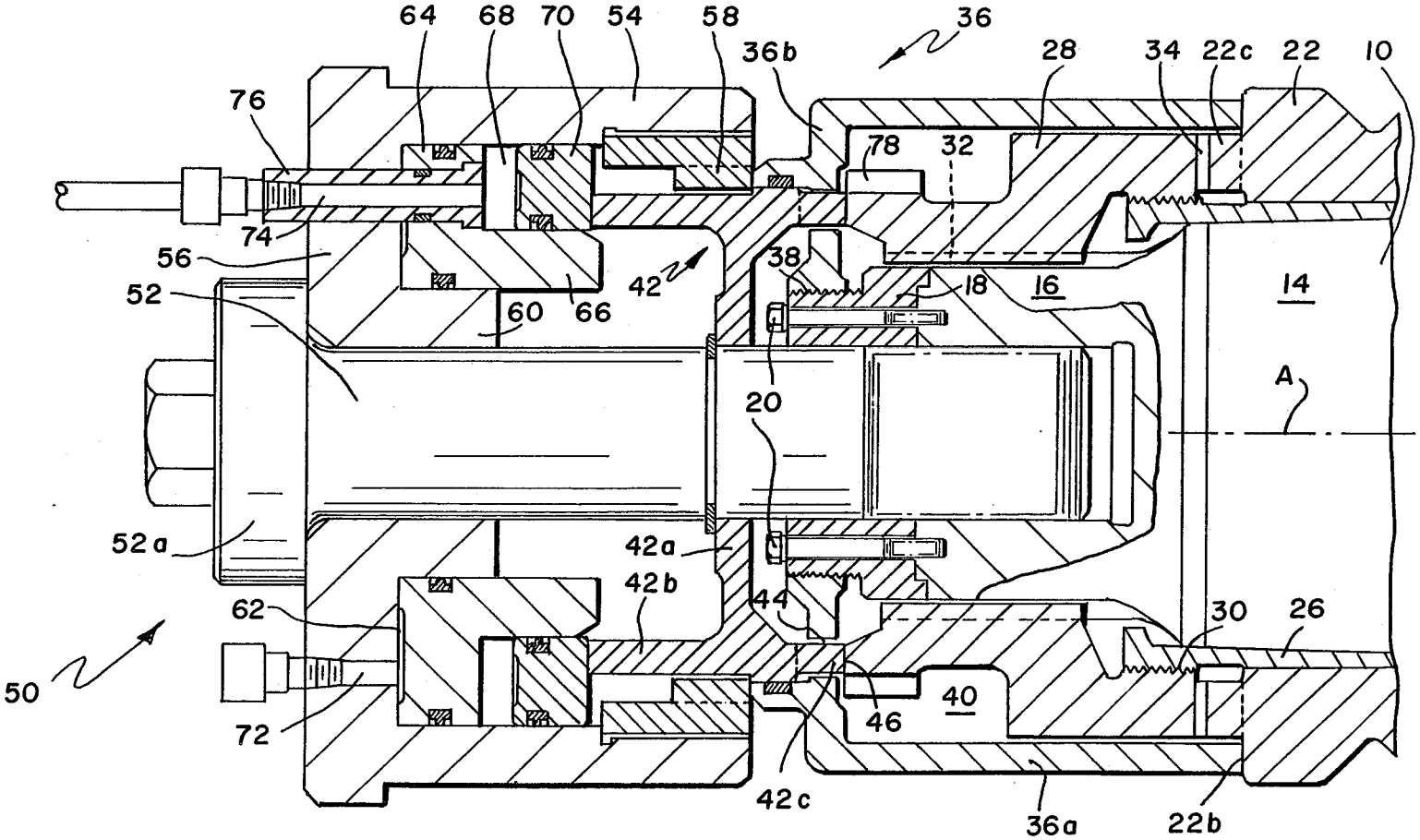
FIG. 6 is a view similar to FIG. 1 showing the application of a hydraulically actuated tool in accordance with the present invention during a roll mounting operation.

Referring now to FIG. 6, a tool 50 is employed to mount the roll assembly. The tool is carried on an extended retainer bolt 52 which is threaded into the shaft end in place of the shorter bolt 48 shown in FIGS. 1, 4 and 5. The tool includes a housing having a cylindrical side wall 54 closed at one end by an end wall 56 and having at its opposite end circumferentially spaced radially inwardly extending lugs 58. The end wall 56 has a cylindrical base 60 seated on the bolt 52. The side wall 54 and the cylindrical base 60 cooperate with the end wall 56 in defining an open ended first annular chamber 62 containing a first piston 64. The first piston 64 includes a cylindrical skirt 66 which cooperates with the housing side wall 54 to define a second annular chamber 68 containing a second piston 70. A first hydraulic port 72 in the housing end wall 56 communicates with the first chamber 62. A second hydraulic port 74 communicates with the second chamber 68. Port 74 is defined by a tubular sleeve 76 which slidably extends through the housing end wall 56 and through the first piston 64.

In the mounting mode depicted in FIG. 6, the tool end wall 56 bears against a collar **52*a* on the retainer bolt 52, and the second piston 70 bears against the skirt 42*b* of collar 42. Hydraulic fluid is admitted to the second chamber 68 via port 74 thereby axially urging the collar 42 against the drive ring 28, which by virtue of its threaded connection 30 to the sleeve 26, serves to push the sleeve into its operatively wedged position between the tapered shaft section 14 and the interior surface of the work roll 22. After the sleeve 26 has been wedged in place, the tool 50 and bolt 52 are removed, the cover 36 is tightened on the end cap 18 to bear against the outer roll face 22*b*, and the shorter retainer bolt 48 is threaded into the shaft end to bring its collar 48*a* to bear against the end wall 42*a* of collar member 42, as shown in FIG. 1**.

Figure 7:
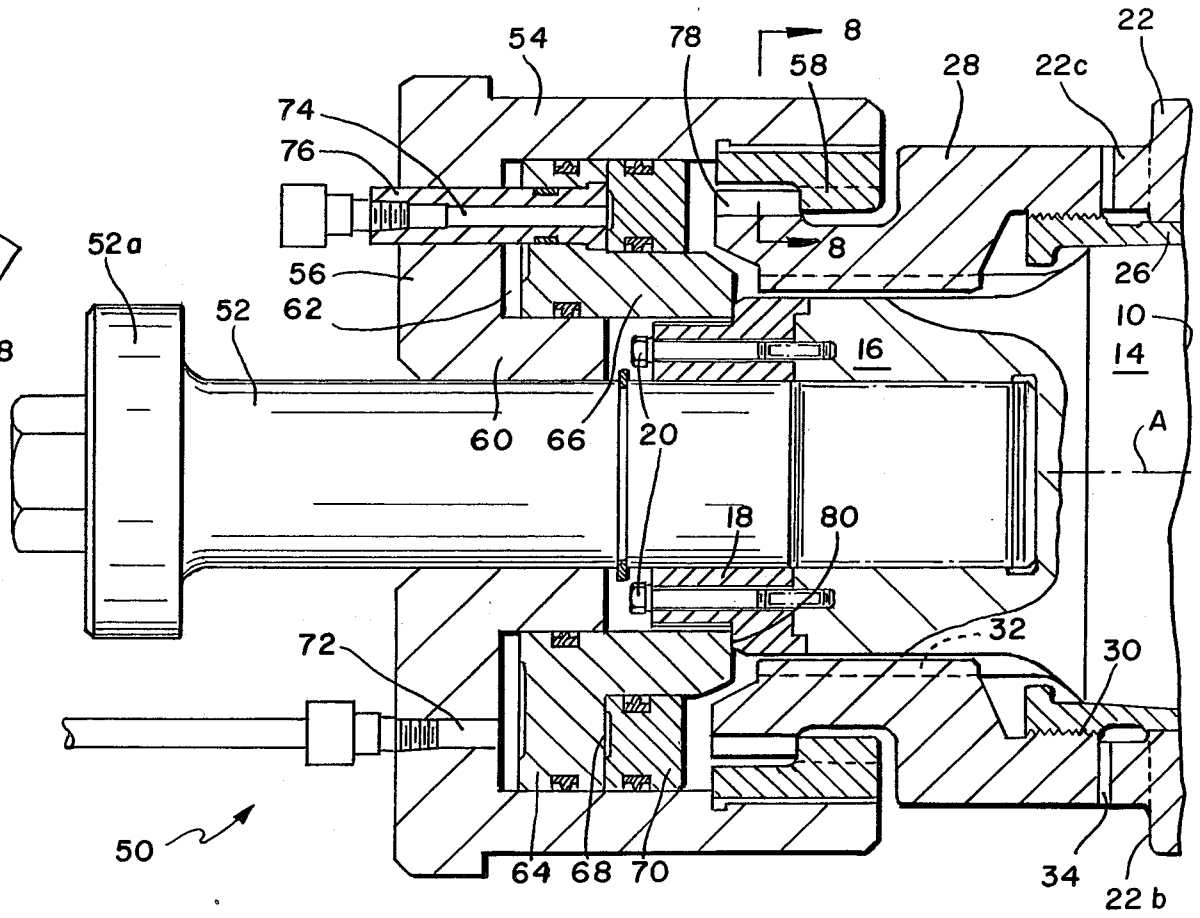
FIG. 7 is a view similar to FIG. 6 showing the application of the same tool during a roll removal operation.
Figure 8:
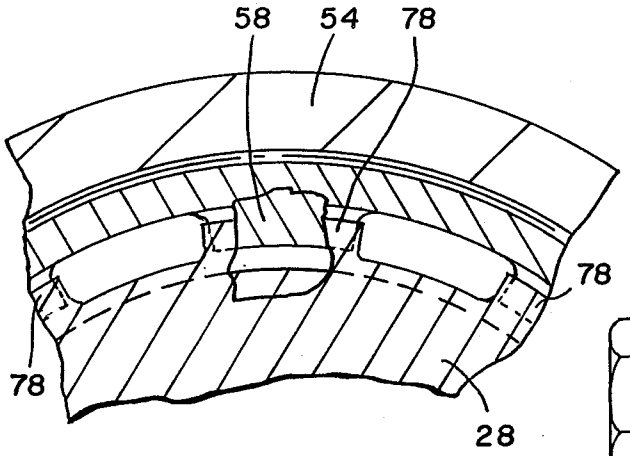
FIG. 8 is a sectional view taken along line 8—8 of FIG. 7.

In the demounting mode, as illustrated in FIGS. 7 and 8, the short retainer bolt 48, collar member 42 and cover 36 are first removed. The tool 50 and longer bolt 52 are then mounted in place, with the lugs 58 of the tool side wall 54 being axially interengaged in a bayonet connection with circumferentially spaced radially outwardly protruding lugs 78 on the drive ring 28. With the skirt 66 on the first piston 64 bearing against the end cap 18 as at 80, hydraulic fluid is admitted into the first chamber 62 via port 72. The drive ring 28 is thus pulled axially away from the work roll 22, thereby extracting the sleeve 26 from its wedged engagement between the tapered shaft portion 14 and the interior roll surface. Once the sleeve has been dislodged, the bolt 52 and tool 50 may be removed, thus clearing the way for a dismantling of the remaining components of the roll assembly.

In light of the foregoing, it now will be appreciated by those skilled in the art that the components of the roll assembly of the present invention can be rapidly and efficiently dismantled and reassembled with the aid of a single hydraulically actuated tool.

When assembled in a running condition, the work roll 22 is securely held concentrically on the tapered shaft portion 14 by the tapered sleeve 26. Torque is efficiently and safely transmitted from the roll shaft 10 to the work roll via the drive ring 28, the latter being splined to the roll shaft as at 32 and having its lugs 34 mechanically interengaged with integral keys **22*c* on the outer work roll face. The drive ring 28 is housed within the cover 36, the latter being threaded on the end cap 18 and serving to axially hold the work roll in place against the flinger 24. By the same token, the sleeve 26 is axially held in place by the retaining action of the collar member 42 acting on the drive ring 28**.

We claim:

1. A rolling mill roll assembly comprising: a roll shaft having a tapered portion and an end portion; an annular roll surrounding said tapered portion, said roll having circumferentially spaced keys on an outer face thereof; a tapered sleeve axially received in a tightly wedged position between said roll and said tapered shaft portion; and, a drive ring connected to said sleeve, said drive ring being splined to said shaft end portion and having lug members axially received between and rotatably interengaged with said keys.

2. The roll assembly of claim 1 further comprising abutment means engageable with an inner face of said roll for axially locating said roll on said shaft.

3. The roll assembly of claim 2 further comprising first retainer means engageable with the outer face of said roll for axially urging said roll against said abutment means.

4. The roll assembly of claim 3 wherein said first retainer means comprises a cover having a cylindrical side wall open at one end and closed at the opposite end by an end wall, the open end of said side wall being in engagement with the outer face of said roll, and said side wall being arranged to surround said interengaged keys and lugs.

5. The roll assembly of claim 4 wherein said first retainer means further comprises a cap member secured to the end of said roll shaft, the end wall of said cover being threadedly engaged om said cap member.

6. The roll assembly of claim 2 further comprising first retainer means for axially urging said roll against said abutment means, and second retainer means for preventing axial removal of said sleeve from between said roll and the tapered portion of said shaft.

7. The roll assembly of claim 6 wherein said first retainer means coacts with said roll and said shaft to define a cylindrical chamber containing said drive ring.

8. The roll assembly of claim 7 wherein said chamber is partially defined by a wall having slots therein, and wherein said second retainer means includes tabs extending through said slots into engagement with said drive ring.

9. The roll assembly of claim 1 further comprising second retainer means for preventing axial removal of said sleeve from between said roll and the tapered portion of said roll shaft.

10. The roll assembly of claim 9 wherein said second retainer means comprises a collar member urged into axial engagement with said drive ring by means of a retainer bolt threaded into the end of said shaft.

11. The roll assembly of claim 10 further comprising a cover enclosing said drive ring, said cover having slots therein and said collar member having tabs thereon arranged to extend through said slots to engage said drive ring.

12. The roll assembly of claim 1 wherein said drive ring is threadedly connected to said sleeve.

13. A rolling mill roll assembly comprising:

a roll shaft having a tapered portion and an end portion;

an annular roll surrounding said tapered portion, said roll having circumferentially spaced keys on an outer face thereof;

abutment means engageable with an inner face of said roll for axially locating said roll on said shaft;

first retainer means engageable with the outer face of said roll for axially urging said roll against said abutment means, said first retainer means including:

(i) a cover having a cylindrical side wall open at one end and closed at the opposite end by an end wall, the other end of said side wall being in engagement with the outer face of said roll, said side wall being arranged to surround said interengaged keys and lugs; and (ii) a cap member secured to the end of said roll shaft, the end wall of said cover being threadedly engaged on said cap member;

a tapered sleeve axially received in a tightly wedged position between said roll and said tapered shaft portion;

a drive ring connected to said sleeve, said drive ring being splined to said shaft end portion and having lug members axially received between and rotatably interengaged with said keys; and second retainer means for preventing axial removal of said sleeve from between said roll and the tapered portion of said roll shaft, said second retainer means including a collar member urged into axial engagement with said drive ring by means of a retainer bolt threaded into the end of said shaft.

* * * * *